US005125623A

United States Patent [19]

Kiedinger

[11] Patent Number: 5,125,623

[45] Date of Patent: Jun. 30, 1992

[54] TAP WATER CONTROL APPARATUS

[76] Inventor: Robert Kiedinger, 2811 Frederick Rd., Opelika, Ala. 36801-7120

[21] Appl. No.: 772,156

[22] Filed: Oct. 7, 1991

[51] Int. Cl.[5] ..... F16K 31/62; F16K 11/10; A47K 1/02

[52] U.S. Cl. ..... 251/295; 4/624; 4/675; 74/512; 137/801; 222/179; 251/303

[58] Field of Search ..... 4/194, 244, 203, 272, 4/280, 622, 624, 626, 308; 137/801, 605, 606; 251/294, 295, 298, 299, 301, 303; 74/500.5, 501.6, 512; 222/179

[56] References Cited

U.S. PATENT DOCUMENTS

| | | | |
|---|---|---|---|
| 1,212,085 | 1/1917 | Metcalf | 251/295 |
| 1,256,525 | 2/1918 | Dederer | 251/295 |
| 1,589,353 | 6/1926 | Bock et al. | 251/295 |
| 1,619,234 | 3/1927 | Beebe | 251/295 |
| 1,627,020 | 5/1927 | Dougherty | 251/295 |
| 1,739,408 | 12/1929 | Medrano et al. | 251/295 |
| 1,864,827 | 6/1932 | Jenkins et al. | 4/249 |
| 2,187,521 | 1/1940 | Mullett | 4/624 |
| 2,467,019 | 4/1949 | Farson | 4/308 |
| 2,713,954 | 7/1955 | Spenner | 222/179 |
| 2,959,980 | 11/1960 | Kocour | 251/295 UX |
| 3,314,084 | 4/1967 | Balikjian | 4/249 |
| 3,594,828 | 7/1971 | Seek | 251/295 |
| 3,594,829 | 7/1971 | Seek | 251/295 |
| 4,015,632 | 4/1977 | Frahm et al. | 137/801 |
| 4,765,003 | 8/1988 | Chang | 4/624 |

*Primary Examiner*—George L. Walton
*Attorney, Agent, or Firm*—Norman B. Rainer

[57] ABSTRACT

An apparatus capable of being installed onto an existing single spout of a plumbing system wherein the spout receives tap water from valves that adjust flow rates from separate lines of hot and cold water utilizes a control valve that attaches to the single spout. The control valve is operated by a foot pedal which communicates with the control valve by a cable whose path is constrained by guides and rollers.

6 Claims, 2 Drawing Sheets

TAP WATER CONTROL APPARATUS

BACKGROUND OF THE INVENTION

1. Field of the Invention

This invention concerns a device for controlling water flow, and more particularly relates to a valve associated with a spout that delivers tap water of desired temperature and pressure to a sink or basin.

2. Description of the Prior Art

The plumbing system in most buildings is designed such that separate hot and cold water lines run to valve mechanisms associated with a sink, basin or tub adapted to receive and subsequently dispose of the water. Some sinks employ separate valves for the hot and cold lines, each valve having a spout from which the water emerges. In other sinks, either two separate or a single combined valve control the flow of hot and cold water, but direct the total water flow through a single spout. In such single spout system, the temperature and force of the emergent water is controlled by the separate, or single combined valve. The convenience of the single spout system is evident in the fact that mixing of hot and cold water within the spout produces a single direct stream of water of desired temperature and velocity. This is to be contrasted with two spout systems where mixing of hot and cold water occurs only in the basin when water is allowed to accumulate therein. Even in a single spout system, a certain amount of inconvenience is involved in manipulating a valve device to secure the desired water temperature and flow rate, said inconvenience being increased when two separate valves are involved and when the operator's hands are covered with grease or other substances which deposit upon the valve.

Foot operated water valves associated with a sink or basin are disclosed in U.S. Pat. Nos. 2,713,954 and 4,765,003. However, such systems involve separate control linkages extending between the pedals and each valve, and the relative flow rates from each valve must be adjusted to produce an output flow from a spout of desired temperature and flow rate.

It is accordingly an object of the present invention to provide apparatus for achieving foot control of the temperature and flow volume of tap water emergent from a spout.

It is another object of this invention to provide apparatus as in the foregoing object which can be easily installed upon the single spout of valved plumbing associated with a sink.

It is a further object of the present invention to provide apparatus of the aforesaid nature which is of simple design and amenable to low cost manufacture.

These objects and other objects and advantages of the invention will be apparent from the following description.

SUMMARY OF THE INVENTION

The above and other beneficial objects and advantages are accomplished in accordance with the present invention by apparatus adapted for use with the single spout of a plumbing system wherein said spout receives tap water from valve means which control flow rates from separate lines of hot and cold water, said hot and cold water mixing adjacent said spout and emerging therefrom into a confining vessel, said apparatus comprised of:

a) a flow control valve threadably attachable to said spout, b) cable means having a proximal extremity adapted to activate said valve and a downwardly directed distal extremity, and c) a spring-biased foot pedal operatively associated with said distal extremity.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the FIGURES of the drawing.

DESCRIPTION OF THE PREFERRED EMBODIMENT

Figure 1:
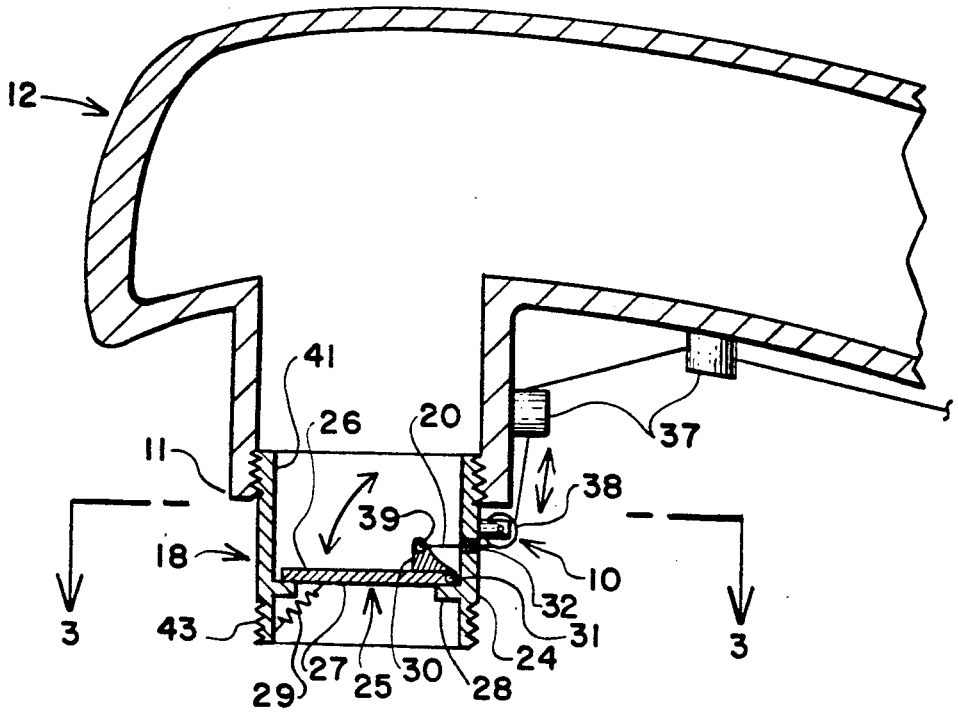
FIG. 1 is a fragmentary sectional side view of an embodiment of the apparatus of the present invention.
Figure 3:
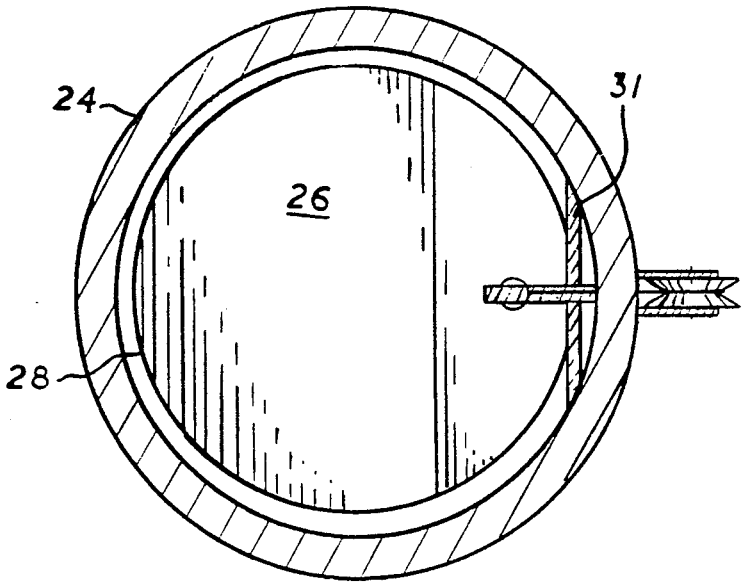
FIG. 3 is a sectional view taken upon the line 3—3 of FIG. 1.
Figure 2:
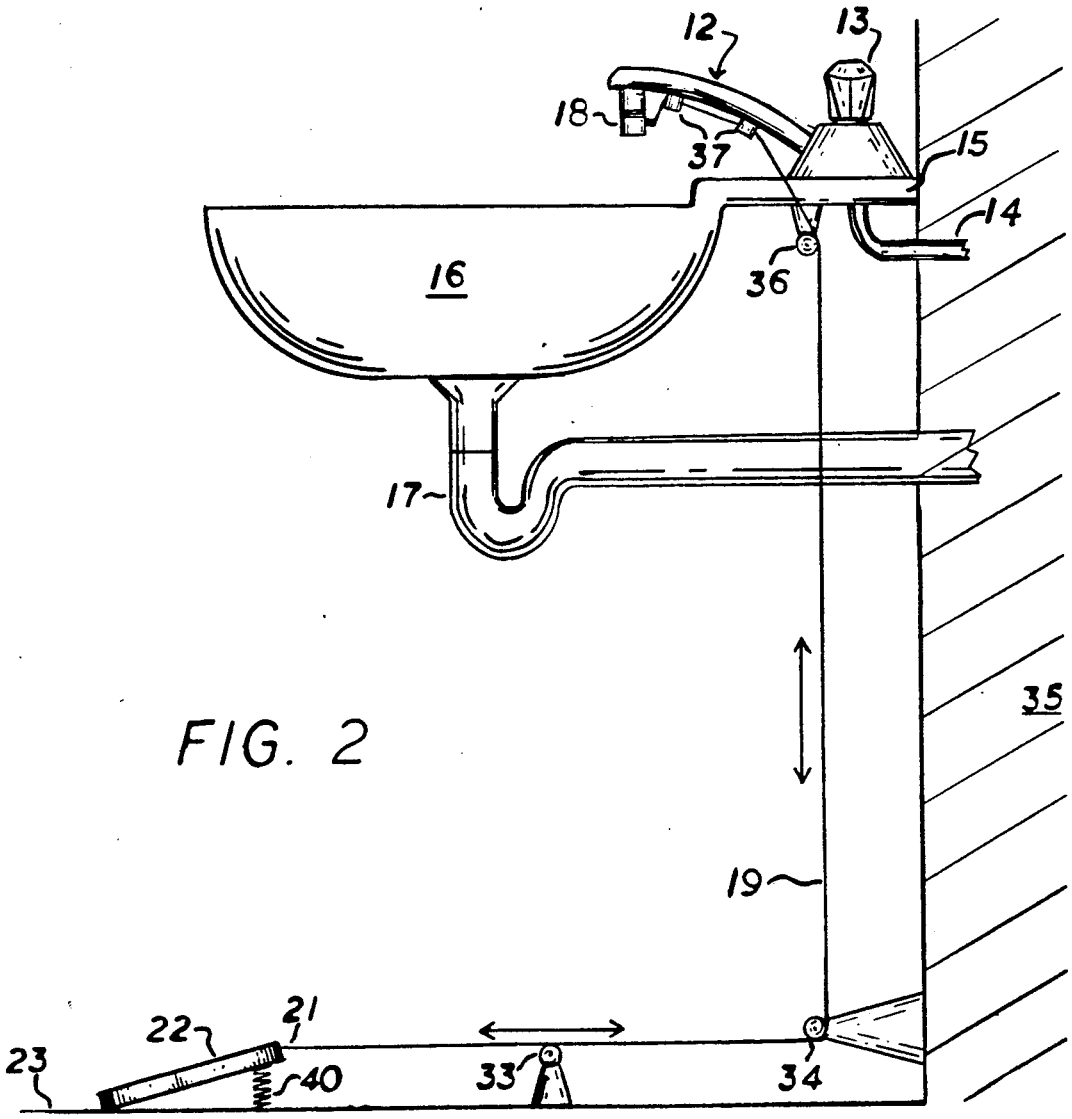
FIG. 2 is a side view of an embodiment of the apparatus of this invention shown in functional relationship with a conventional sink equipped with a single spout plumbing system to deliver tap water.

Referring to FIGS. 1 to 3, an embodiment of the apparatus 10 of the present invention is shown in operational association with the exit extremity 11 of spout 12 of a plumbing system further comprised of conventional faucet valve 13 and associated inlet pipe 14 for hot or cold water, shelf means 15 that supports spout 12 and valve 13, sink basin 16 disposed below spout 12, and drain line 17 extending from the bottom of said basin.

Apparatus 10 is comprised of flow control valve 18 threadably joined to exit extremity 11 of said spout, cable 19 having proximal extremity 20 and downwardly directed distal extremity 21, and spring-biased foot pedal 22 positioned on floor 23 and operatively associated with said cable.

The exemplified embodiment of valve 18 is comprised of cylindrical sleeve 24 having an externally threaded upper extremity 41 that engages exit extremity 11 of spout 12. Lower extremity 43 of sleeve 24 also contains external threading to permit attachment of a conventional screen which smoothes the flow of water emergent from the spout. A flapper-type mechanism is disposed within said sleeve and comprised of circular valve plate 25 orthogonally disposed to the axis of said sleeve and having upper and lower surfaces 26 and 27 respectively. Lower surface 27 is adapted to abut against sealing flange 28 inwardly disposed from sleeve 24. A coil spring 29 under tension extends from sleeve 24 below valve plate 25 to lower surface 26. An upwardly directed fulcrum bar 30 extends from surface 26. A hinge pin 31 disposed perpendicularly to fulcrum bar 30 tangentially engages plate 25 and is supported by sleeve 24. A sealing bushing 32 penetrates sleeve 24 in radial alignment with fulcrum bar 30.

From its attachment to pedal 22, cable 29 travels over first pulley wheel 33, then below and around second pulley wheel 34 supported by wall 35, thence to third pulley wheel 36 associated with shelf means 15, thence through fixed guides 37, thence to fourth pulley wheel 38 supported by sleeve 24, thence through bushing 32 and finally attaching to aperture 39 in the upper portion of fulcrum bar 30. By virtue of such manner of disposition, the section of cable between the second and third pulley wheels is pulled downwardly when pedal 22 is depressed. Such action pivots valve plate 25 upwardly, away from contact with sealing flange 28. When downward pressure is released from the pedal, a restoring spring 40 forces the pedal to its uppermost position. Such action permits reverse movement of the cable and enables spring 29 to bring valve plate 25 back into abutment with sealing flange 28.

Because of the placement of flow control valve 18 upon the exit extremity of the single spout that services sink 16, the one or two faucet valves that ordinarily adjust the flows of hot and cold water to the spout can be pre-set to a degree of closure that produces water of a desired temperature and flow rate. When flow control valve 18 is opened in the aforesaid manner, water of the pre-selected temperature and pressure is automatically delivered from spout 12.

In other embodiments, cable 19 may be completely enclosed by an outer sheath. For example, sheathed cables of the general type employed as motorcycle throttle cables may be used. In still further embodiments, different types of valve 18 may be utilized.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus adapted for use with the single spout of a plumbing system wherein an inlet end of said spout receives tap water from valve means which control flow rates from separate lines of hot and cold water, said hot and cold water mixing adjacent said spout and discharging from an outlet end of said spout and into a confining vessel, said apparatus comprised of:

a) a flow control valve having an upper extremity that is threadably detachable to said outlet end of said spout, b) cable means having a proximal end connected to said flow control valve and a distal end and c) a spring-biased foot pedal connected to said distal end for activating said flow control valve, whereby d) when said foot pedal is depressed independent of the actuation of said hot and cold water valve means, water flows through said control valve, and when said foot pedal is released, water ceases to flow through said control valve irregardless of the position of said hot and cold water valve means.

2. The apparatus of claim 1 wherein said cable means interacts with at least two pulley wheels in the course of its travel between said valve and said foot pedal.

3. The apparatus of claim 2 wherein said cable is constrained to passage through guide means disposed below said single spout.

4. The apparatus of claim 3 wherein said guide means are incorporated as a standard design feature of said single spout.

5. The apparatus of claim 3 wherein said control valve is comprised of a cylindrical sleeve whose lower extremity contains external threading which accommodates other fixtures.

6. The apparatus of claim 5 wherein said other fixture is a screen.

* * * * *